US012716263B2

(12) United States Patent
MacDonnell

(10) Patent No.: US 12,716,263 B2
(45) Date of Patent: Aug. 25, 2026

(54) POST PULLING DEVICE

(71) Applicant: Derek MacDonnell, Sturgeon County (CA)

(72) Inventor: Derek MacDonnell, Sturgeon County (CA)

( * ) Notice: Subject to any disclaimer, the term of this patent is extended or adjusted under 35 U.S.C. 154(b) by 339 days.

(21) Appl. No.: 18/521,048

(22) Filed: Nov. 28, 2023

(65) Prior Publication Data

US 2025/0172013 A1 May 29, 2025

(51) Int. Cl.
*E04H 17/26* (2006.01)

(52) U.S. Cl.
CPC ..... *E04H 17/265* (2013.01)

(58) Field of Classification Search
CPC ... E04H 17/265; E04H 17/261; E04H 17/263; B25C 11/00
See application file for complete search history.

(56) References Cited

U.S. PATENT DOCUMENTS 5,186,437 A * 2/1993 Scott ..... B66F 15/00 254/132
7,040,602 B1 * 5/2006 Williams ..... E04H 17/265 254/30
2023/0101508 A1 * 3/2023 Nice ..... E04H 17/265 254/28

* cited by examiner

*Primary Examiner* — Christopher J. Besler
(74) *Attorney, Agent, or Firm* — Orin Del Vecchio

(57) ABSTRACT

A post pulling device that is configured to surroundably mount a post and be operably coupled to a lifting machine so as to facilitate removal of the post from the ground. The present invention includes a body wherein the body is planar in manner having a first side and a second side. The body has a post aperture formed therein proximate the second side that is annular in shape. The post aperture includes a beveled perimeter edge that facilitates improved engagement with a post. The body has a plurality of reinforcement members secured to the second side of the body wherein the reinforcement members are longitudinally oriented between the first end and second end of the body. A connection aperture is formed in the body proximate the first end and is operable to have a fastener coupled thereto.

3 Claims, 3 Drawing Sheets

POST PULLING DEVICE

FIELD OF THE INVENTION

The present invention relates generally to tools, more specifically but not by way of limitation, a device that is configured to operably engage a post such as but not limited to a fence post wherein the device is coupled to a lifting machine and is employed to facilitate removal of the post from the ground.

BACKGROUND

Large wooden posts are employed for various types of construction projects. Posts of various sizes are utilized for constructing structures such as but not limited to fences, docks and decks. While some applications employ small metal posts only a few inches in diameter, many applications employ large wooden posts that can vary in size and by example but not limitation be eight inches in diameter.

While the posts serve their purpose for the constructed structure, many times these posts need to be removed either for maintenance, repair or replacement. Removing large posts can be an arduous task as many times the posts have at least several feet buried in the ground. Additionally, the larger posts can be quite heavy and as such manipulation of the post for removal thereof is quite difficult.

Accordingly, there is a need for a fence post pulling device wherein the present invention can be operably coupled to a post and coupled to a lifting machine wherein the machine and post pulling device facilitate easy removal of the post from the ground.

SUMMARY OF THE INVENTION

It is the object of the present invention to provide a post pulling device configured to be operably coupled to a post wherein the present invention includes a body that is planar in manner and is manufactured from a rigid material.

Another object of the present invention is to provide a device configured to be utilized in conjunction with a lifting machine to facilitate removal of posts from the ground wherein the body has a first side and a second side.

A further object of the present invention is to provide a post pulling device configured to be operably coupled to a post wherein the present invention includes a post aperture formed proximate the second end of the body.

Yet a further object of the present invention is to provide a device configured to be utilized in conjunction with a lifting machine to facilitate removal of posts from the ground wherein the post aperture includes a perimeter edge that has a beveled angled form.

Still another object of the present invention is to provide a post pulling device configured to be operably coupled to a post wherein the body includes reinforcement members secured to the second side of the body.

An additional object of the present invention is to provide a device configured to be utilized in conjunction with a lifting machine to facilitate removal of posts from the ground wherein the body has formed therein a connection aperture proximate the first end of the body.

Yet a further object of the present invention is to provide a post pulling device configured to be operably coupled to a post wherein the fence post aperture can be provided in alternate sizes.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
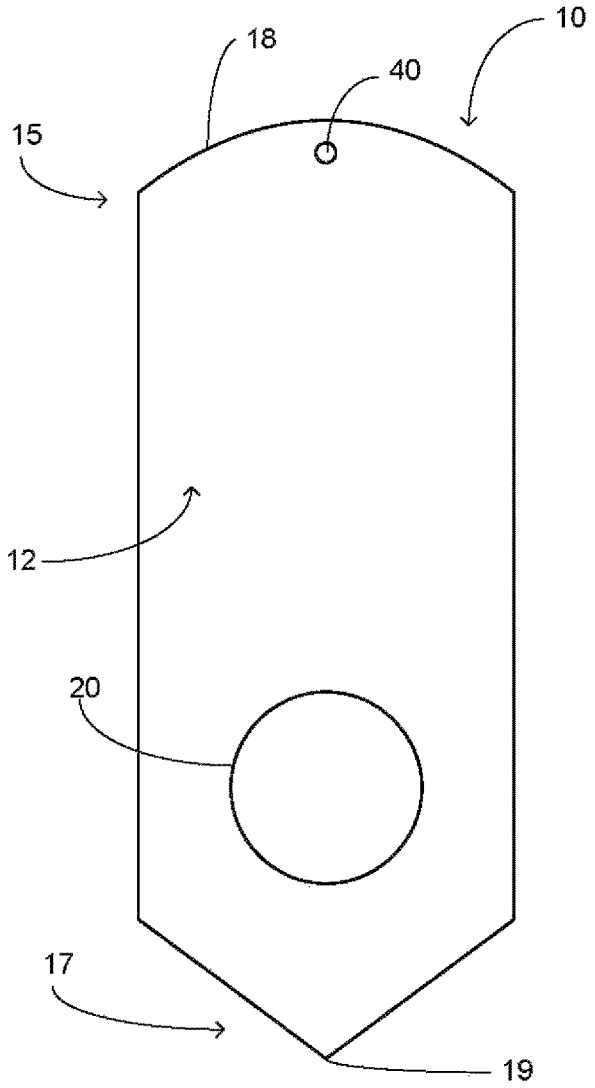
FIG. 1 is a top view of the first side of the present invention.
Figure 2:
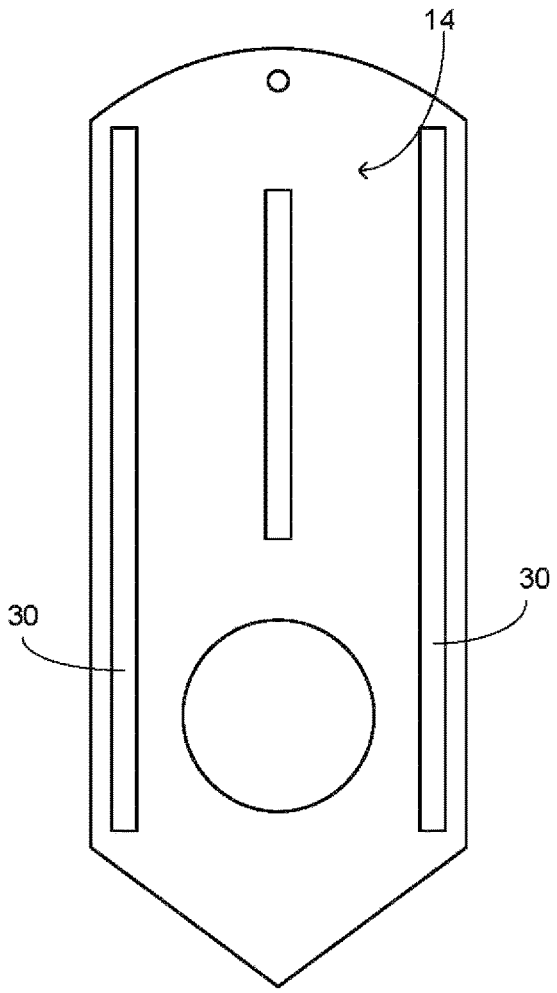
FIG. 2 is a top view of the second side of the present invention.
Figure 3:
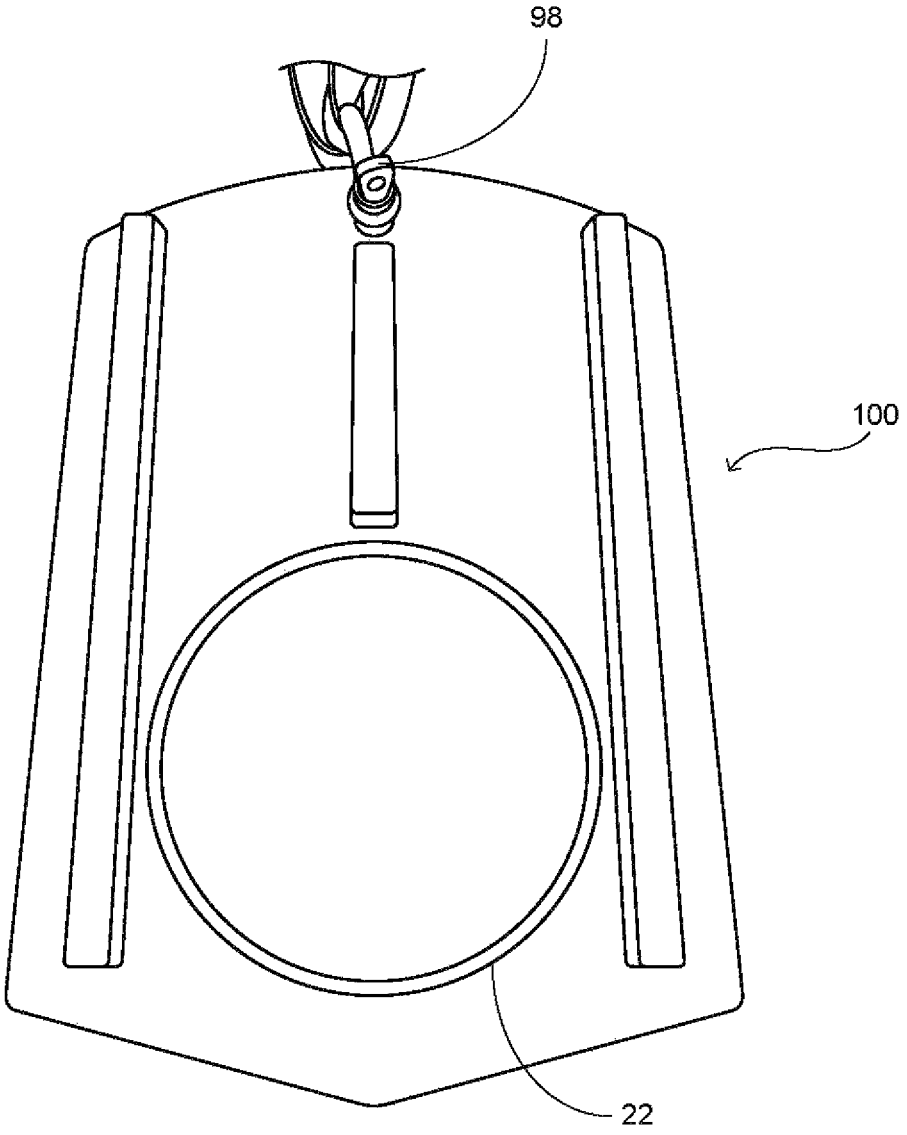
FIG. 3 is a perspective view of the present invention.
Figure 4:
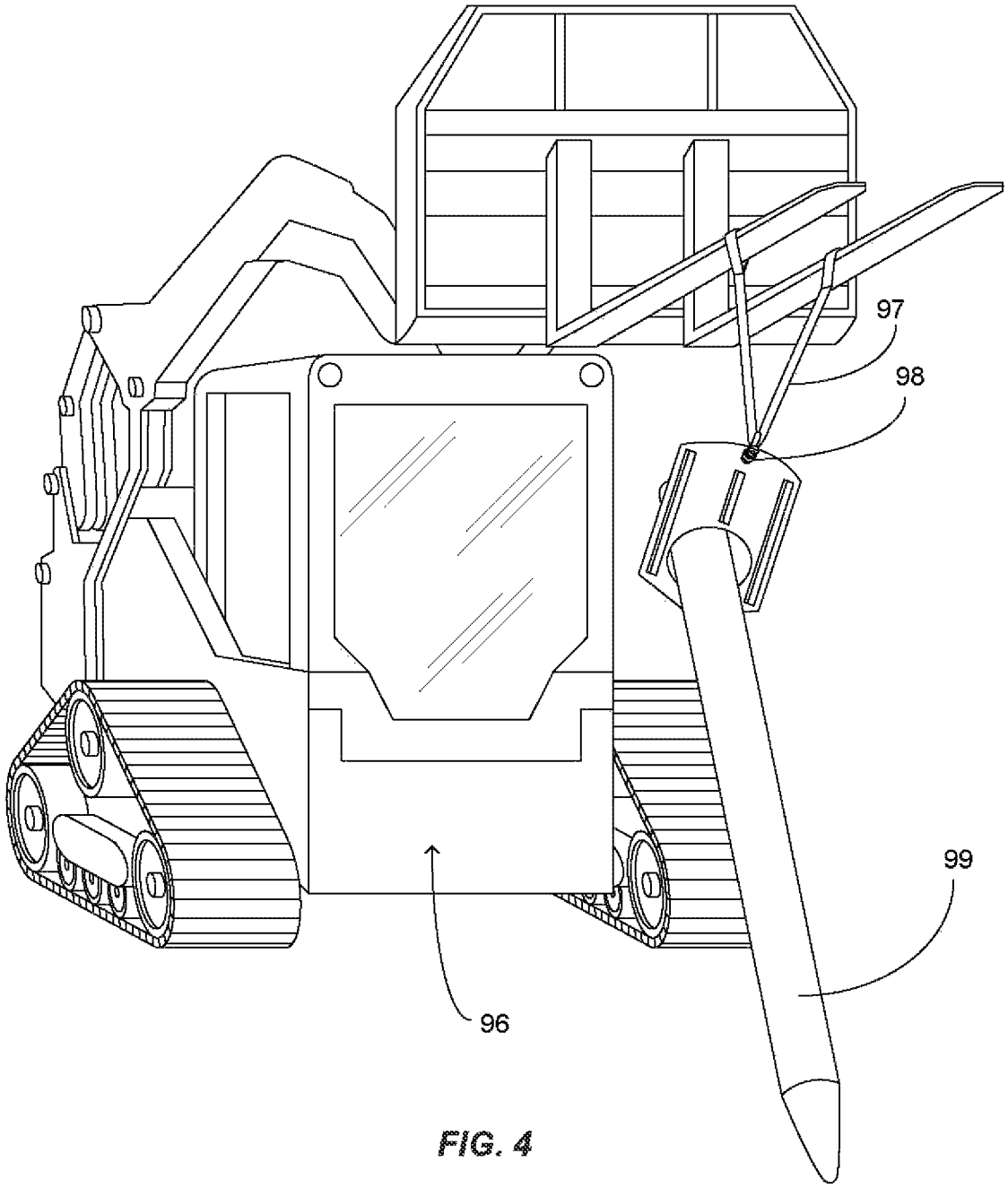
FIG. 4 is a perspective view of the present invention coupled to a lifting machine and an exemplary post.

Referring now to the drawings submitted herewith, wherein various elements depicted therein are not necessarily drawn to scale and wherein through the views and figures like elements are referenced with identical reference numerals, there is illustrated a post pulling device 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the post pulling device 100 includes a body 10. The body 10 is manufactured from a rigid material such as but not limited to metal. The body 10 includes a first side 12 and a second side 14 and is planar in manner. The body 10 includes a first end 15 and second end 17. The first end 15 has an outer edge 18 having a radius providing an arcuate shape to the first end 15. The second end 17 is tapered in form providing an apex point 19 thereto. While the body 10 is illustrated herein having a particular shape, it is contemplated within the scope of the present invention that the body 10 could be provided in alternate shapes and sizes.

Formed in the body 10 proximate the second end 17 is post aperture 20. The post aperture 20 is annular in shape and is configured to have a post 99 journaled therethrough and engage therewith. It should be understood within the scope of the present invention that the post aperture 20 could be provided in alternate sizes. The post aperture 20 includes beveled edge 22 wherein the beveled edge 22 is formed at an angle. The beveled edge 22 and the angle thereof functions to provide improved engagement with the post 99 during the pulling of the post 99 from the ground. It should be understood within the scope of the present invention that the angle of the beveled edge 22 could be formed at various angles to provide the desired functionality as described herein. While one post aperture 20 is illustrated and discussed herein, it is contemplated within the scope of the present invention that the body 10 could have more than one post aperture 20 formed therein and wherein the post apertures could have different diameters.

Secured to the second side 14 of the body 10 are reinforcement members 30. The reinforcement members 30 are elongated in form and secured to the second side 14 utilizing suitable techniques such as but not limited to welding. The reinforcement members 30 are manufactured from a rigid material such as but not limited to metal. The reinforcement members 30 extend longitudinally on the body 10 intermediate the first end 15 and second end 17 so as to inhibit the body 10 from bending during use of the post pulling device 100. While three reinforcement members 30 are illustrated herein, it is contemplated within the scope of the present invention that the body 10 could employ less or more than three reinforcement members 30.

A connection aperture 40 is formed in the body 10 proximate the first end 15 generally aligned with a centerline of the body 10. The connection aperture 40 is annular in shape and is configured to be coupled to exemplary fastener 98. Fastener 98 is coupled to strap 97 facilitating coupling to the exemplary lifting machine 96. It should be understood within the scope of the present invention that various types of lifting equipment could be operably coupled to the body 10. Furthermore, it is contemplated within the scope of the present invention that the body 10 could have more than one connection aperture 40 in order to facilitate coupling the body 10 to alternate types of fasteners.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A post pulling device configured to assist in extraction of posts partially buried in a ground wherein the post pulling device comprises:

a body, said body having a first side and a second side, said first side and said second side each being planar, said body having a first end and a second end, said body being manufactured from a rigid material;

at least one post aperture, said at least one post aperture being formed in said body proximate said second end, said at least one post aperture being annular in shape and dimensioned to receive an end of a post;

a connection aperture, said connection aperture being formed in said body proximate said first end, said connection aperture configured to facilitate coupling said body to a fastener;

a reinforcement member secured to and extending perpendicular from the second side of said body, said reinforcement member being elongated in shape, and oriented longitudinally on said second side of said body between the connection aperture and the post aperture; and two additional reinforcement members oriented longitudinally on said second side of said body between said first end and said second end and adjacent to said post aperture on opposing sides of said post aperture.

2. The post pulling device configured to assist in extraction of posts partially buried in the ground as recited in claim 1, wherein said at least one post aperture includes a beveled edge, said beveled edge having an angle configured to facilitate engagement with a post.

3. The post pulling device configured to assist in extraction of posts partially buried in the ground as recited in claim 2, wherein said body is manufactured from metal.

* * * * *